US011906231B2

(12) United States Patent
Broadbent et al.

(10) Patent No.: US 11,906,231 B2
(45) Date of Patent: Feb. 20, 2024

(54) ICE MAKER WITH PUSH NOTIFICATION TO INDICATE WHEN MAINTENANCE IS REQUIRED

(71) Applicant: True Manufacturing Co., Inc., O'Fallon, MO (US)

(72) Inventors: John Allen Broadbent, Denver, CO (US); Paolo Moro, Milan (IT)

(73) Assignee: TRUE MANUFACTURING COMPANY, INC., O'Fallon, MO (US)

( * ) Notice: Subject to any disclaimer, the term of this patent is extended or adjusted under 35 U.S.C. 154(b) by 303 days.

(21) Appl. No.: 16/991,128

(22) Filed: Aug. 12, 2020

(65) Prior Publication Data

US 2020/0370812 A1 Nov. 26, 2020

Related U.S. Application Data

(63) Continuation of application No. 15/152,300, filed on May 11, 2016, now Pat. No. 10,775,089.

(Continued)

(51) Int. Cl.

*F25D 29/00* (2006.01)
*F25C 5/00* (2018.01)

(Continued)

(52) U.S. Cl.

CPC ..... *F25C 5/10* (2013.01); *F25C 5/20* (2018.01); *F25C 2400/12* (2013.01);

(Continued)

(58) Field of Classification Search

CPC ..... F25B 2600/01; F25B 2600/023; F25D 2500/04; F25D 2600/02

See application file for complete search history.

(56) References Cited

U.S. PATENT DOCUMENTS 5,035,118 A 7/1991 Hara
5,829,257 A * 11/1998 Newman ..... F25C 5/10 62/73

(Continued)

FOREIGN PATENT DOCUMENTS

JP 2005282971 A 7/1997
JP 9178314 A 10/2005

OTHER PUBLICATIONS

Patent Cooperation Treaty, International Search Report for PCT/US2016/031865, dated Aug. 26, 2016, 3.

(Continued)

*Primary Examiner* — Nelson J Nieves
*Assistant Examiner* — Meraj A Shaikh
(74) *Attorney, Agent, or Firm* — Stinson LLP

(57) ABSTRACT

An ice maker for forming ice having a refrigeration system, a water system, and a control system. The refrigeration system includes a compressor, a condenser, and an evaporator. The water system includes a water filter and a sump to hold water to be made into ice. The control system includes a controller adapted to determine a baseline freeze time, a baseline harvest time, and/or a baseline fill time after an initial set of ice making cycles and is further adapted to compare subsequent harvest times, freeze times, and/or fill times to the baseline freeze, harvest, and/or fill times to determine whether the ice maker needs maintenance. If controller determines that ice maker needs maintenance, controller can push a notification to a portable electronic device connected to the ice maker.

16 Claims, 6 Drawing Sheets

Related U.S. Application Data

(60) Provisional application No. 62/159,400, filed on May 11, 2015.

(51) Int. Cl.
*F25C 5/10* (2006.01)
*F25C 5/20* (2018.01)

(52) U.S. Cl.
CPC ..... *F25C 2400/14* (2013.01); *F25C 2600/02* (2013.01); *F25C 2600/04* (2013.01)

(56) References Cited

U.S. PATENT DOCUMENTS 5,839,286 A * 11/1998 Lee ..... F25C 1/04 62/233
5,878,583 A * 3/1999 Schlosser ..... F25C 1/12 62/73
6,574,974 B1 * 6/2003 Herzog ..... F25C 1/04 62/135
7,062,892 B2 * 6/2006 Metzger ..... B65B 57/14 53/127
7,204,091 B2 4/2007 Allison et al.
11,482,100 B2 * 10/2022 Tatourian ..... G08G 1/096741
2006/0086134 A1 4/2006 Voglewede et al.
2006/0277928 A1 * 12/2006 McDougal ..... F25C 5/187 62/340
2008/0092562 A1 4/2008 Allison et al.
2008/0092574 A1 * 4/2008 Doberstein ..... F25C 1/04 62/233
2008/0125882 A1 * 5/2008 Broadbent ..... F25C 5/00 700/50
2012/0192575 A1 * 8/2012 Tirumala ..... F25C 1/00 62/157
2014/0208781 A1 7/2014 Broadbent
2014/0216071 A1 8/2014 Broadbent
2014/0266755 A1 * 9/2014 Arensmeier ..... F24F 11/49 340/679
2016/0047584 A1 * 2/2016 Bahel ..... F25B 49/005 62/115

OTHER PUBLICATIONS

Supplementary European Search Report, Application No. 16793455.3-1009 dated Dec. 5, 2018, p. 9.

* cited by examiner

ICE MAKER WITH PUSH NOTIFICATION TO INDICATE WHEN MAINTENANCE IS REQUIRED

CROSS REFERENCE TO RELATED APPLICATIONS

This application is a continuation of U.S. patent application Ser. No. 15/152,300 filed May 11, 2016 which claims priority to U.S. Provisional Patent Application Ser. No. 62/159,400 filed May 11, 2015. Each of these applications is incorporated herein by reference in its entirety.

FIELD OF THE INVENTION

The present invention relates to automatic ice makers, and more particularly to ice makers with the ability to communicate with portable electronic devices to indicate when maintenance of the ice maker is required.

BACKGROUND OF THE INVENTION

Ice making machines, or ice makers, typically comprise a refrigeration and water system that employs a source of refrigerant flowing serially through a compressor, a condenser, a refrigerant expansion device, an evaporator, and a freeze plate comprising a lattice-type cube mold thermally coupled with the evaporator. Additionally, typical ice makers employ gravity water flow and ice harvest systems that are well known and in extensive use. Ice makers having such a refrigeration and water system are often disposed on top of ice storage bins, where ice that has been harvested is stored until it is needed. Such ice makers may also be of the "self-contained" type wherein the ice maker and ice storage bin are a single unit. Such ice makers have received wide acceptance and are particularly desirable for commercial installations such as restaurants, bars, motels and various beverage retailers having a high and continuous demand for fresh ice.

U.S. Ser. No. 14/172,374 entitled "Controlling Refrigeration Appliances with a Portable Electronic Device" filed on Feb. 4, 2014 by Broadbent and published as US. Pub. No. 2014/0216071, which is incorporated herein by reference in its entirety, describes how an ice maker can interface with a portable electronic device—e.g., a smart phone.

This present application discusses data which can be collected by the ice maker in order to recommend actions that should be taken and displayed on the smart phone when a smart phone is connected or reconnected.

SUMMARY OF THE INVENTION

In an aspect of the invention, the ice maker has the ability to detect three conditions that indicate the possibility of a problem and then may recommend corrective action to an end user. The ice maker could communicate this information when a smart phone is connected (or reconnected) to the ice maker.

The first condition is that the condenser and/or condenser air filter of the ice maker needs cleaning. By keeping track of how long the freeze portion of each ice making cycle takes, the ice maker can infer whether the ice making performance is slowly degrading over time. If it is, the most likely culprit is that the condenser and/or the condenser air filter is getting dirty. Thus, the next time the ice maker is connected (or reconnected) to a smart phone, the ice maker may recommend to the user/servicer that the condenser and/or condenser air filter should be checked or cleaned.

The second condition is that descaling of the evaporator and/or sump of the ice maker is needed. The presence of scale on the evaporator of the ice maker will slow the ice harvesting process. Because the ice maker can easily measure and track the time it takes to harvest ice, the ice maker can detect an increase in harvest time and the next time the ice maker is connected (or reconnected) to a smart phone, the ice maker may recommend to the user/servicer that the ice maker be descaled.

The third condition is that cleaning or replacement of the water filter of the ice maker is needed. As water filters age and need to be replaced, the flow rate of water through them will begin to slow. By monitoring the time it takes to fill the sump with water, the ice maker can determine the slowing water flow rate. When the smart phone connects (or reconnects) with the ice maker, the ice maker may recommend to the user/servicer that the water filter be cleaned or replaced.

One aspect of the invention is directed to an ice maker for forming ice, the ice maker comprising a refrigeration system, a water system, and a controller. The refrigeration system comprises a compressor, a condenser, and an evaporator, wherein the compressor, condenser and evaporator are in fluid communication by one or more refrigerant lines. The water system comprises a water filter and a sump to hold water to be made into ice. The control system comprises a controller adapted to determine a baseline freeze time, a baseline harvest time, and/or a baseline fill time after an initial set of ice making cycles. The controller is further adapted to compare subsequent harvest times, freeze times, and/or fill times to the baseline freeze, harvest, and/or fill times to determine whether the ice maker needs maintenance.

Another aspect of the invention is directed to an ice maker, wherein the controller is adapted to push a notification to a portable electronic device when the portable electronic device is connected to the controller, wherein the notification includes a notification to clean the condenser, descale the ice maker, and/or clean or replace the water filter.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

Like reference numerals indicate corresponding parts throughout the several views of the various drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Figure 1:
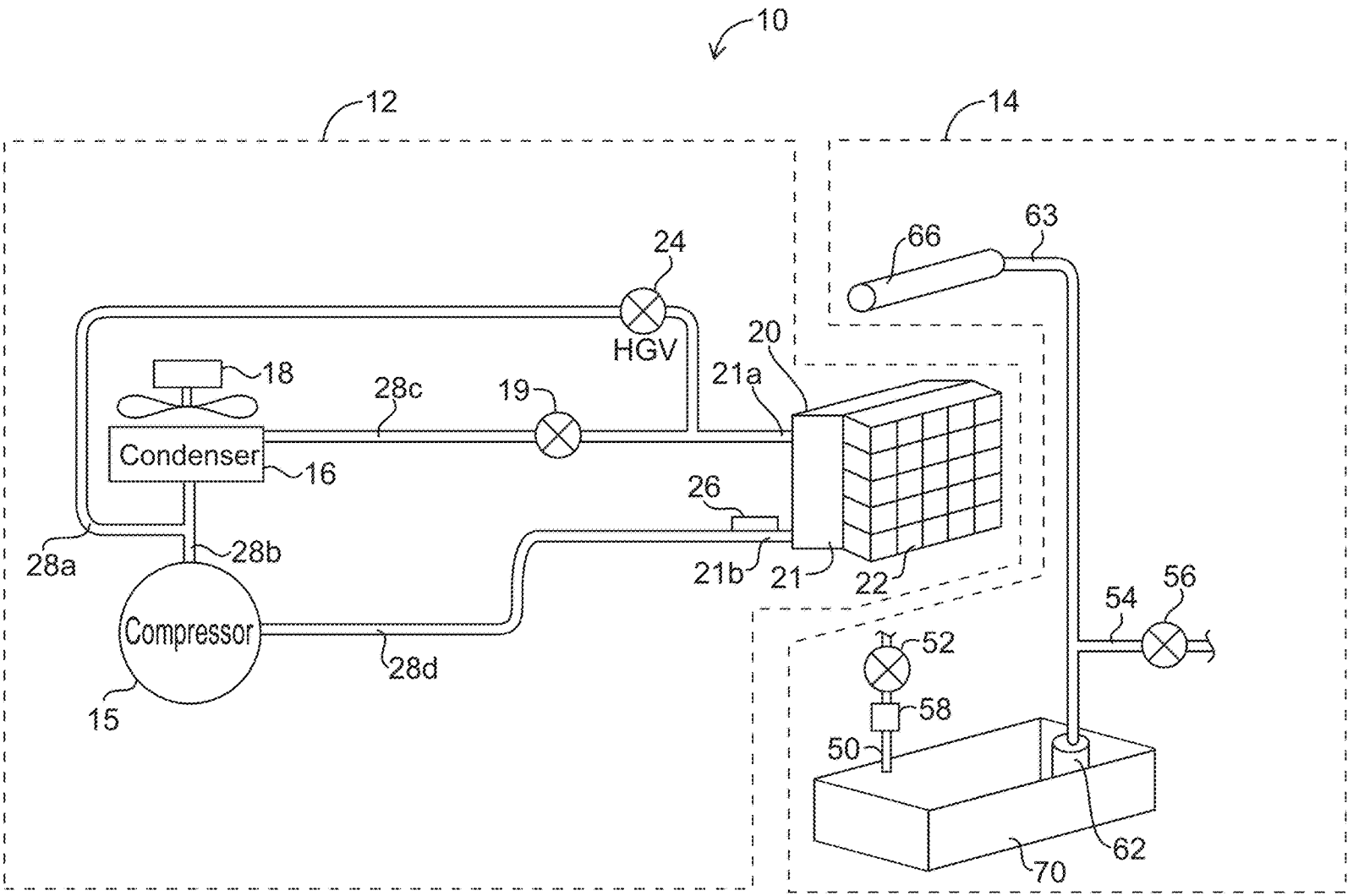
FIG. 1 is a schematic drawing of an ice maker having various components according to an embodiment of the invention.

FIG. 1 illustrates certain principal components of one embodiment of a grid-type ice maker 10 having a refrigeration system 12 and water system 14. The refrigeration system 12 of ice maker 10 includes compressor 15, condenser 16 for condensing compressed refrigerant vapor discharged from the compressor 15, refrigerant expansion device 19 for lowering the temperature and pressure of the refrigerant, ice formation device 20, and hot gas valve 24. Refrigerant expansion device 19 may include, but is not limited to, a capillary tube, a thermostatic expansion valve or an electronic expansion valve. Ice formation device 20 includes evaporator 21 and freeze plate 22 thermally coupled to evaporator 21. Evaporator 21 is constructed of serpentine tubing (not shown) as is known in the art. Freeze plate 22 contains a large number of pockets (usually in the form of a grid of cells) on its surface where water flowing over the surface can collect. Hot gas valve 24 is used to direct warm refrigerant from compressor 15 directly to evaporator 21 to remove or harvest ice cubes from freeze plate 22 when the ice has reached the desired thickness.

Ice maker 10 also includes a temperature sensor 26 placed at the outlet of the evaporator 21 to control refrigerant expansion device 19. If refrigerant expansion device 19 is a thermal expansion valve (TXV), then sensor 26 and expansion device 19 are connected by a capillary tube (not shown) that allows expansion device 19 to be controlled by temperature sensor 26 via the pressure of the refrigerant contained therein. If refrigerant expansion device 19 is an electronic expansion valve, then temperature sensor 26 may be in electrical, signal, and/or data communication with controller 80 which in turn may be in electrical, signal, and/or data communication with refrigerant expansion device 19 to control refrigerant expansion device 19 in response to the temperature measured by temperature sensor 26 (see FIG. 2). In various embodiments, for example, temperature sensor 26 may be in electrical, signal, and/or data communication with refrigerant expansion device 19. In other embodiments, where refrigerant expansion device 19 is an electronic expansion valve, ice maker 10 may also include a pressure sensor (not shown) placed at the outlet of the evaporator 21 to control refrigerant expansion device 19 as is known in the art.

Condenser 16 may be a conventional condenser having a population of refrigerant passes (e.g., serpentine tubing, micro-channels) and a population fins. A condenser fan 18 may be positioned to blow a gaseous cooling medium (e.g., air) across condenser 16 to provide cooling of condenser 16.

As described more fully elsewhere herein, a form of refrigerant cycles through the components of refrigeration system 12 via refrigerant lines 28*a*, 28*b*, 28*c*, 28*d*.

The water system 14 of ice maker 10 includes water pump 62, water line 63, water distributor 66 (e.g., manifold, pan, tube, etc.), and sump 70 located below freeze plate 22 adapted to hold water. During operation of ice maker 10, as water is pumped from sump 70 by water pump 62 through water line 63 and out of water distributor 66, the water impinges on freeze plate 22, flows over the pockets of freeze plate 22 and freezes into ice. Sump 70 may be positioned below freeze plate 22 to catch the water coming off of freeze plate 22 such that the water may be recirculated by water pump 62. Water distributor 66 may be the water distributors described in U.S. Ser. No. 14/167,089 entitled "Water Distributor for an Ice Maker" filed on Jan. 29, 2014 by Broadbent and published as US. Pub. No. 2014/0208792, which is incorporated herein by reference in its entirety.

Water system 14 of ice maker 10 further includes water supply line 50 and water inlet valve 52 in fluid communication therewith for filling sump 70 with water from a water source (not shown), wherein some or all of the supplied water may be frozen into ice. A water filter 58 may be provided on water supply line to filter the incoming water from the water source. Water system 14 of ice maker 10 further includes water discharge line 54 and discharge valve 56 (e.g., purge valve, drain valve) disposed thereon. Water and/or any contaminants remaining in sump 70 after ice has been formed may be discharged via water discharge line 54 and discharge valve 56. In various embodiments, water discharge line 54 may be in fluid communication with water line 63. Accordingly, water in sump 70 may be discharged from sump 70 by opening discharge valve 56 when water pump 62 is running.

In addition to the components described above, ice maker 10 may have other conventional components not described herein without departing from the scope of the invention.

Having described each of the individual components of one embodiment of ice maker 10, the manner in which the components interact and operate in various embodiments may now be described in reference again to FIG. 1. During operation of ice maker 10 in an ice making cycle, compressor 15 receives low-pressure, substantially gaseous refrigerant from evaporator 21 through suction line 28*d*, pressurizes the refrigerant, and discharges high-pressure, substantially gaseous refrigerant through discharge line 28*b* to condenser 16. In condenser 16, heat is removed from the refrigerant, causing the substantially gaseous refrigerant to condense into a substantially liquid refrigerant. The heat is removed from condenser 16 by controller 80 operating condenser fan motor 18*a* in a forward direction to draw ambient air from outside ice maker 10 across condenser 16. Condenser fan 18 preferably operates continuously in the forward direction during the ice making cycle. The substantially liquid refrigerant exiting condenser 16 may include some gas such that the refrigerant is a liquid-gas mixture.

After exiting condenser 16, the high-pressure, substantially liquid refrigerant is routed through liquid line 28*c* to refrigerant expansion device 19, which reduces the pressure of the substantially liquid refrigerant for introduction into evaporator 21 at inlet 21*a*. As the low-pressure expanded refrigerant is passed through tubing of evaporator 21, the refrigerant absorbs heat from the tubes contained within evaporator 21 and vaporizes as the refrigerant passes through the tubes. Low-pressure, substantially gaseous refrigerant is discharged from outlet 21*b* of evaporator 21 through suction line 28*d*, and is reintroduced into the inlet of compressor 15.

In certain embodiments of the invention, at the start of the ice making cycle, a water fill valve 52 is turned on to supply a mass of water to sump 70 and water pump 62 is turned on. The ice maker will freeze some or all of the mass of water into ice. After the desired mass of water is supplied to sump 70, the water fill valve may be closed. Compressor 15 is turned on to begin the flow of refrigerant through refrigeration system 12. Water pump 62 circulates the water over freeze plate 22 via water line 63 and water distributor 66. The water that is supplied by water pump 62 then begins to cool as it contacts freeze plate 22, returns to water sump 70 below freeze plate 22 and is recirculated by water pump 62 to freeze plate 22. Once the water is sufficiently cold, water flowing across freeze plate 22 starts forming ice cubes.

After the ice cubes are formed such that the desired ice cube thickness is reached, water pump 62 is turned off and the harvest portion of the ice making cycle is initiated by opening hot gas valve 24. This allows warm, high-pressure gas from compressor 15 to flow through hot gas bypass line 28*a* to enter evaporator 21 at inlet 21*a*. The warm refrigerant flows through the serpentine tubing of evaporator 21 and a heat transfer occurs between the warm refrigerant and the evaporator 21. This heat transfer warms evaporator 21, freeze plate 22, and the ice formed in freeze plate 22. This results in melting of the formed ice to a degree such that the ice may be released from freeze plate 22 and falls into ice storage bin 31 where the ice can be temporarily stored and later retrieved.

Figure 2:
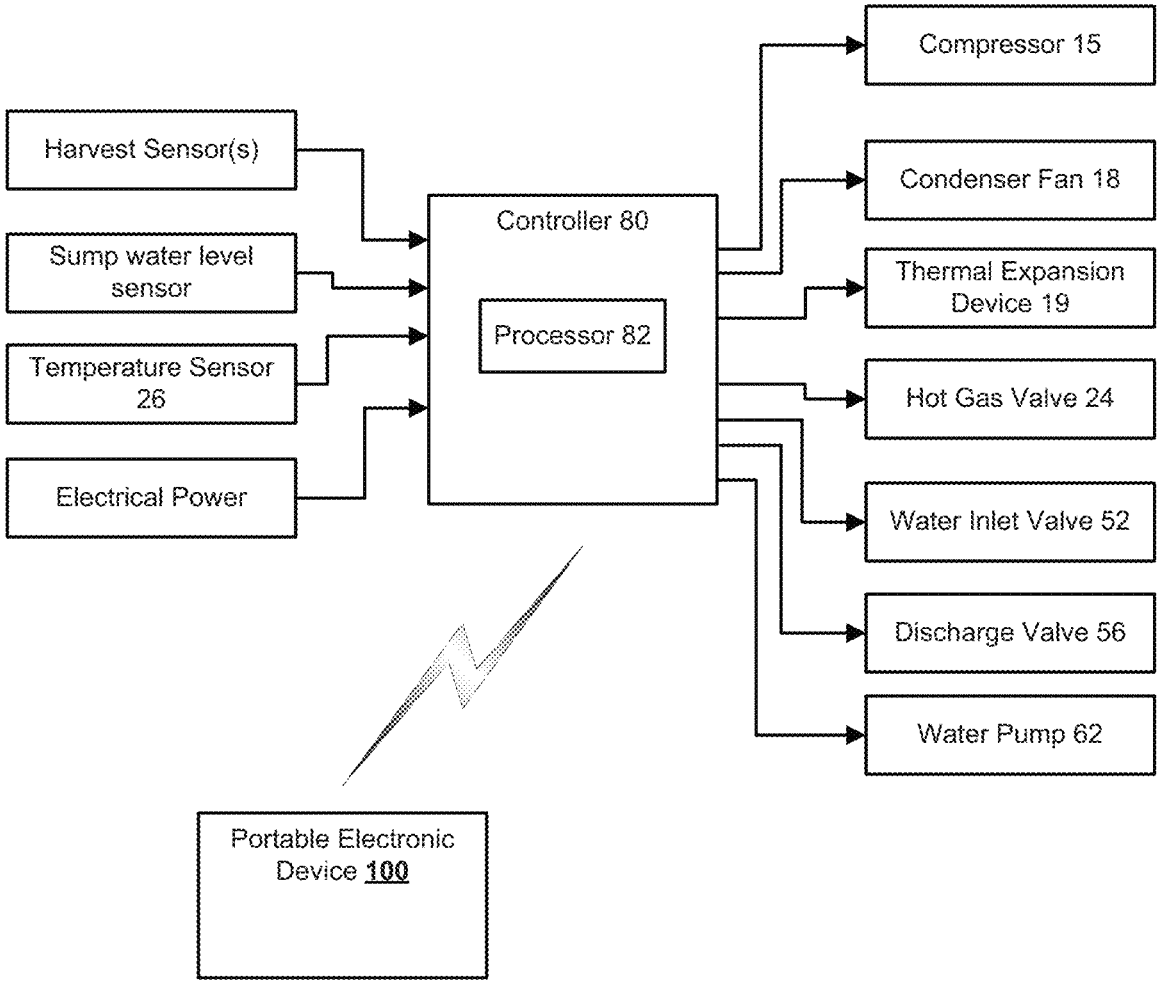
FIG. 2 is a schematic drawing of a controller for controlling the operation of the various components of an ice maker according to the an embodiment of the invention.

Referring now to FIG. 2, each of ice maker 10 also include a controller 80. Controller 80 may be located in ice maker 10 remote from ice formation device 20 and sump 70. Controller 80 may include a processor 82 for controlling the operation of ice maker 10. Processor 82 of controller 80 may include a processor-readable medium storing code representing instructions to cause processor 82 to perform a process. Processor 82 may be, for example, a commercially available microprocessor, an application-specific integrated circuit (ASIC) or a combination of ASICs, which are designed to achieve one or more specific functions, or enable one or more specific devices or applications. In yet another embodiment, controller 80 may be an analog or digital circuit, or a combination of multiple circuits. Controller 80 may also include one or more memory components (not shown) for storing data or programs in a form retrievable by controller 80. Controller 80 can store data in or retrieve data from the one or more memory components.

In various embodiments, controller 80 may also comprise input/output (I/O) components (not shown) to communicate with and/or control the various components of ice maker 10. In certain embodiments, for example controller 80 may receive inputs from a harvest sensor, temperature sensor(s) 26 (see FIG. 1), a sump water level sensor, ice level sensor (not shown), an electrical power source (not shown), and/or a variety of sensors and/or switches including, but not limited to, pressure transducers, acoustic sensors, etc. In various embodiments, based on those inputs for example, controller 80 may be able to control compressor 15, condenser fan motor 18*a*, refrigerant expansion device 19, hot gas valve 24, water inlet valve 52, discharge valve 56, and/or water pump 62. Controller 80 may also transmit and receive data, signals, messages, and/or any other information with a portable electronic device, a remote computer, a remote server, a network, etc. In various embodiments, portable electronic device 100 may include a smartphone, a tablet computer, a portable music player (e.g., an mp3 player), a portable gaming device, a computer, and/or any type of portable electronic device which can be adapted to control ice maker 10. Additional details of controller 80 and portable electronic device 100 may be found in U.S. Ser. No. 14/172,374 entitled "Controlling Refrigeration Appliances with a Portable Electronic Device" filed on Feb. 4, 2014 by Broadbent and published as US. Pub. No. 2014/0216071, which is incorporated herein by reference in its entirety.

Controller 80 of Ice maker 10 may establish a data communication connection with a portable electronic device 100. It is desirable that when the portable electronic device 100 is connected with controller 80 of ice maker 10, controller 80 transmits recommendations for service based on data gathered by the controller 80 of ice maker 10. Controller 80 monitors or tracks at least three parameters to recommend maintenance or service actions for ice maker 10. Generally speaking, controller 80 will communicate to portable electronic device 100 to (1) check or clean the condenser or check or clean the condenser air filter if the freeze cycle has gotten significantly longer than when ice maker 10 was new; (2) descale ice maker 10 if the harvest cycle has gotten significantly longer than when ice maker 10 was new; and (3). change the water filter if the fill time has gotten significantly longer than when ice maker 10 was new.

Figure 3:
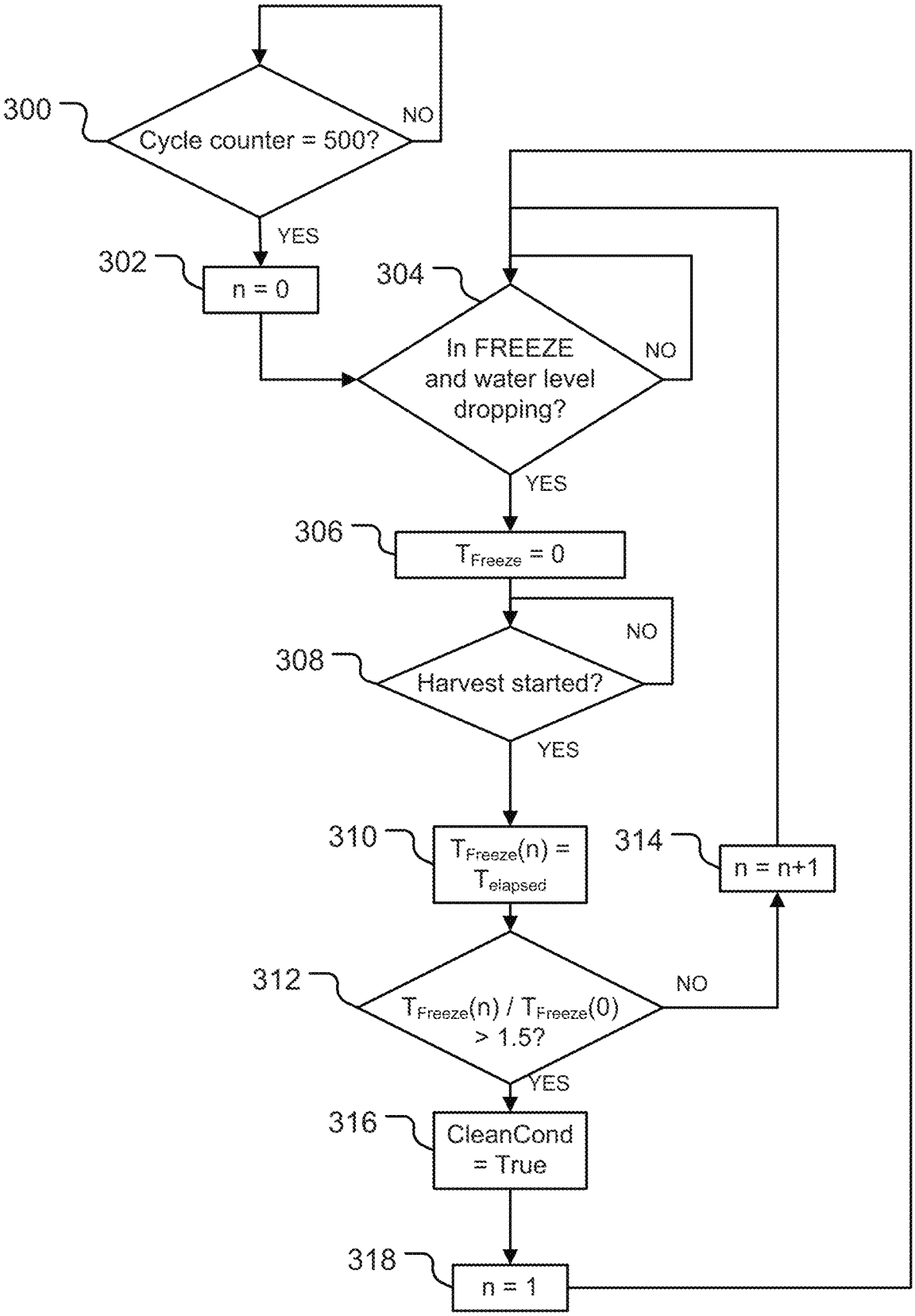
FIG. 3 is flow chart describing a method of determining whether the condenser and/or condenser air filter of the ice maker needs to be checked or cleaned according to an embodiment of the invention.

Referring now to FIG. 3, a method for determining when cleaning condenser 16 or the condenser air filter (not shown) is illustrated. To determine when cleaning is needed, controller 80 of ice maker 10 tracks the time it takes to freeze each batch of ice cubes. Controller 80 will then compare that freeze time to a baseline freeze time to determine whether the freeze time has grown too long over time. If the freeze time has increased beyond a certain tolerance, controller 80 may determine that something is wrong, most likely, condenser 16 or the condenser air filter has become clogged or dirty and needs to be cleaned. If controller 80 of ice maker 10 detects this problem, controller 80 may communicate to portable electronic device 100 a recommendation that condenser 16 and/or the condenser air filter be checked or cleaned or replaced.

To determine whether checking or cleaning is needed, controller 80 of ice maker 10 first measures a baseline freeze time. This baseline should be created after ice maker 10 has been installed in its final location and has been running for a period of time. Preferably, controller 80 will determine the baseline freeze time after about 500 freeze cycles. This may equate to about 10 days of continuous operation of ice maker 10. Waiting to calculate the baseline freeze time until about 500 cycles allows for factory testing, and/or operation at trade shows or at a dealership and may ensure that ice maker 10 is its final location and has been running at said location for a period of time. In certain embodiments, the number of cycles may be less than about 500 (e.g., about 100, about 200, about 300, about 400). In yet other embodiments, the number of cycles may be more than about 500 (e.g., about 600, about 700, about 800, about 900, about 1000).

Next, the freeze time is preferably measured in a way that is least impacted by other factors (other than condenser filter cleanliness). Because the time required to freeze ice varies with both the water temperature and the ambient air temperature, it is preferred to measure the freeze time when the water level in sump 70 begins to drop. This is because the water level only begins to drop when the water has reached 32° F. (0° C.). At that point in time the temperature of the incoming water no longer matters. An exemplary water level sensor and system for measuring the water level in sump 70 is described in U.S. Ser. No. 14/162,365 entitled "Apparatus and Method for Sensing Ice Thickness and Detecting Failure Modes of an Ice Maker" filed on Jan. 23, 2014 by Broadbent and published as US. Pub. No. 2014/0208781, which is incorporated herein by reference in its entirety.

With continued reference to FIG. 3, at step 300, controller 80 checks whether ice maker 10 has completed 500 cycles. If it has, indicating that ice maker 10 has been operating in its final location, the cycle counter n is set to zero (0) at step 302. Then at step 304, controller 80 checks whether ice maker 10 is in the part of the ice making cycle where ice is being made (i.e., the FREEZE cycle when compressor 15 is on and hot gas valve 24 is closed) and that the water level in sump 70 has begun to drop. If the water level in sump is dropping, controller 80 proceeds to step 306, otherwise controller 80 will continue to wait until the water level in sump 70 begins to drop. At step 306, a timer, preferably implemented in controller 80, for timing the length of time it takes to freeze a batch of ice is reset to zero ($T_{Freeze}$=0). At step 308, controller 80 waits until harvest has initiated, indicating that freezing has finished. When harvest has started at step 308, controller 80 records the elapsed time "$T_{elapsed}$" as variable $T_{Freeze}(0)$ at step 310. This $T_{Freeze}(0)$ is the baseline length of time that it takes ice maker 10 to freeze a batch of ice when condenser 16 and/or condenser air filter is new and clean.

At step 312, controller 80 checks to determine whether the freeze time of the current cycle $T_{Freeze}(n)$ has exceeded freeze time of the first recorded cycle $T_{Freeze}(0)$ (the baseline freeze time) by about 50%. During the initial baseline run when n=0, $T_{Freeze}(n)$ is equal to $T_{Freeze}(0)$ and therefore controller 80 will proceed to step 314. At step 314, cycle counter n is incremented by 1. Ice maker 10 will then continue to make ice and controller 80 will repeat steps 304 through 312. Condenser 16 and/or condenser air filter (not shown) will gather dirt, dust, debris, grease, and/or other contaminants and the time it takes to freeze a batch of ice will increase. Thus if at step 312, controller 80 determines that the current freeze time $T_{Freeze}(n)$ has exceeded the baseline freeze time ($T_{Freeze}(0)$) by about 50%, then at step 316 controller 80 sets a flag labeled "CleanCond" to "TRUE". This indicates that controller 80 has determined that condenser 16 and/or condenser air filter need to be checked or cleaned. In various embodiments, the "CleanCond" flag may be set to "TRUE" if controller 80 determines that current freeze time $T_{Freeze}(n)$ is from about 1.25 to about 2.0 times the baseline freeze time $T_{Freeze}(0)$) (e.g., about 1.25 times, about 1.5 times, about 1.75 times, about 2.0 times). At step 318, the cycle counter n is then set to 1. Controller 80 then goes back to step 304 to begin monitoring freeze times again.

Because the cycle counter n is set to 1 in step 318, the baseline freeze time ($T_{Freeze}(0)$) remains unchanged. This is important because the baseline freeze time should be when condenser 16 and/or condenser air filter is brand new and clean, not dirty as it would be when the CleanCond flag is set to TRUE.

Figure 6:
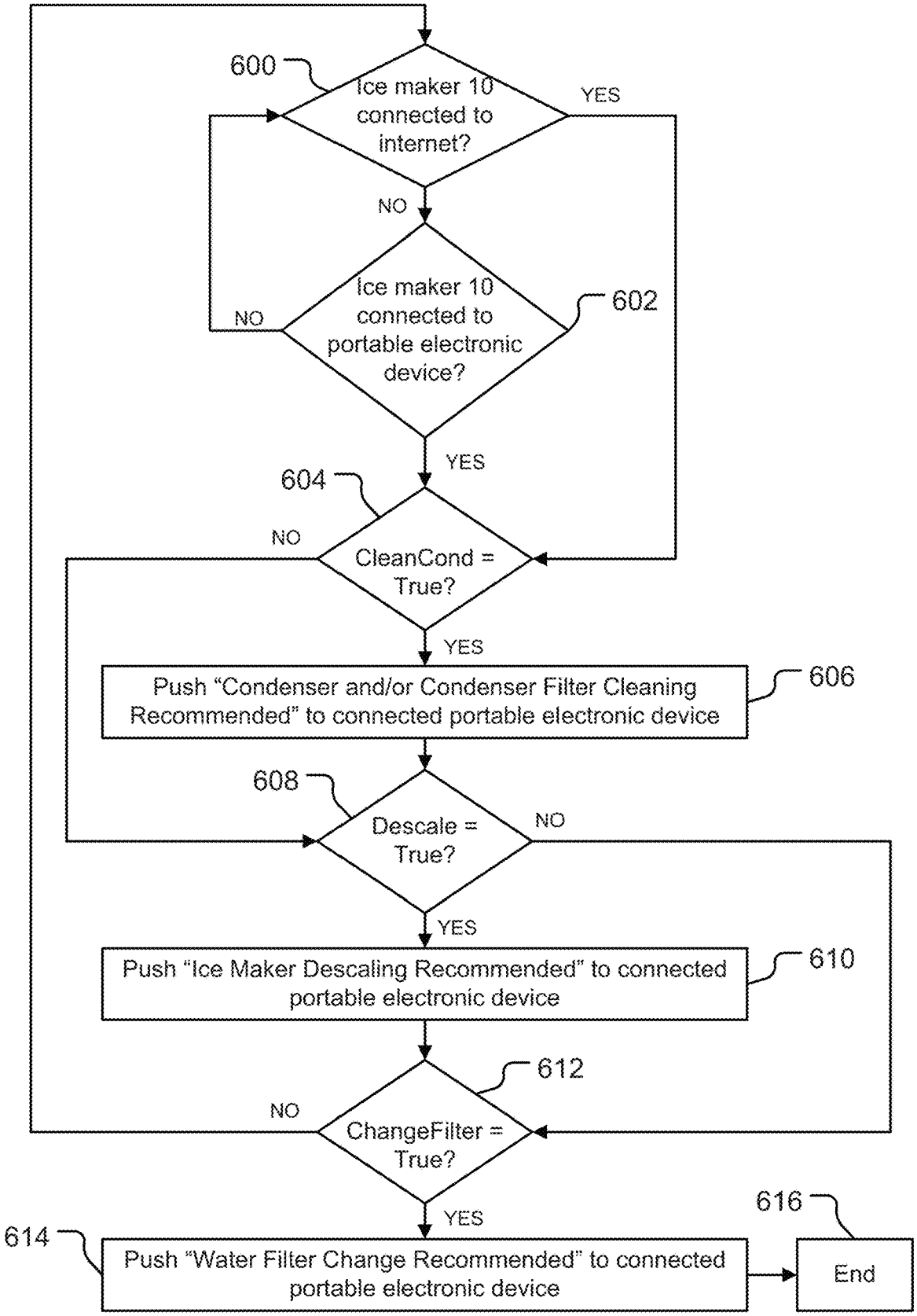
FIG. 6 is flow chart describing a method of pushing a notification that maintenance of the ice maker is recommended according to an embodiment of the invention.

If the CleanCond flag is set to True, The ice machine will push a recommendation to the portable electronic device 100 (upon reconnection) to check or clean condenser 16 and/or the condenser air filter as shown in step 414 of FIG. 6.

FIG. 3 shows a similar flowchart for controller 80 of ice maker 10 to monitor harvesting time in order to recommend descaling of ice maker 10 when appropriate. As in FIG. 3, in FIG. 2 ice maker 10 captures a baseline harvest time when the machine reaches 500 cycles. This is done so that the baseline harvest time is occurring after ice maker 10 has run for some length of time in its final location. In certain embodiments, the number of cycles may be less than about 500 (e.g., about 100, about 200, about 300, about 400). In yet other embodiments, the number of cycles may be more than about 500 (e.g., about 600, about 700, about 800, about 900, about 1000).

Thus at step 400, controller 80 checks whether ice maker 10 has reached 500 ice making cycles. If 500 cycles have been reached, then at step 402, controller sets cycle counter n to 0. At step 404, ice maker 10 checks whether ice maker 10 has begun a harvest cycle (i.e., when hot gas valve 24 opens). If harvest is initiated, controller 80 proceeds to step 406, otherwise controller 80 will continue to wait until harvest is initiated. At step 406, a timer, preferably implemented in controller 80, for timing the length of time it takes to for a batch of ice to be harvested is reset to zero ($T_H$=0). At step 408, controller 80 waits until harvest has completed. When harvest has started at step 408, controller 80 records the elapsed time "$T_{elapsed}$" as variable $T_H(0)$ at step 310. This $T_H(0)$ is the baseline length of time that it takes ice maker 10 to harvest a batch of ice when ice maker 10 is new and clean.

At step 412, controller 80 checks to determine whether the harvest time of the current cycle $T_H(n)$ has exceeded harvest time of the first recorded cycle $T_H(0)$ (the baseline harvest time) by about 50%. During the initial baseline run when n=0, $T_H(n)$ is equal to $T_H(0)$ and therefore controller 80 will proceed to step 414. At step 414, cycle counter n is incremented by 1. Ice maker 10 will then continue to make ice and controller 80 will repeat steps 404 through 412. Over time, as ice maker 10 continues to make ice, scale and mineral deposits will form on and/or in evaporator 21 and water system 14 (e.g., sump 70, water distributor 66, water line 63, etc.) of ice maker 10 and the time it takes to harvest a batch of ice will increase. Thus if at step 412, controller 80 determines that the current harvest time $T_H(n)$ has exceeded the baseline harvest time ($T_H(0)$) by about 50%, then at step 416 controller 80 sets a flag labeled "Descale" to "TRUE". This indicates that controller 80 has determined that ice maker 10 needs to be descaled. In various embodiments, the "Descale" flag may be set to "TRUE" if controller 80 determines that current harvest time $T_H(n)$ is from about 1.25 to about 2.0 times the baseline harvest time $T_H(0)$) (e.g., about 1.25 times, about 1.5 times, about 1.75 times, about 2.0 times). At step 418, the cycle counter n is then set to 1. Controller 80 then goes back to step 404 to begin monitoring harvest times again.

Because the cycle counter n is set to 1 in step 418, the baseline harvest time ($T_H(0)$) remains unchanged. This is important because the baseline harvest time should be when evaporator 21 and water system 14 of ice maker 10 is brand new and clean of any scale, not scaled as it would be when the Descale flag is set to TRUE.

Figure 5:
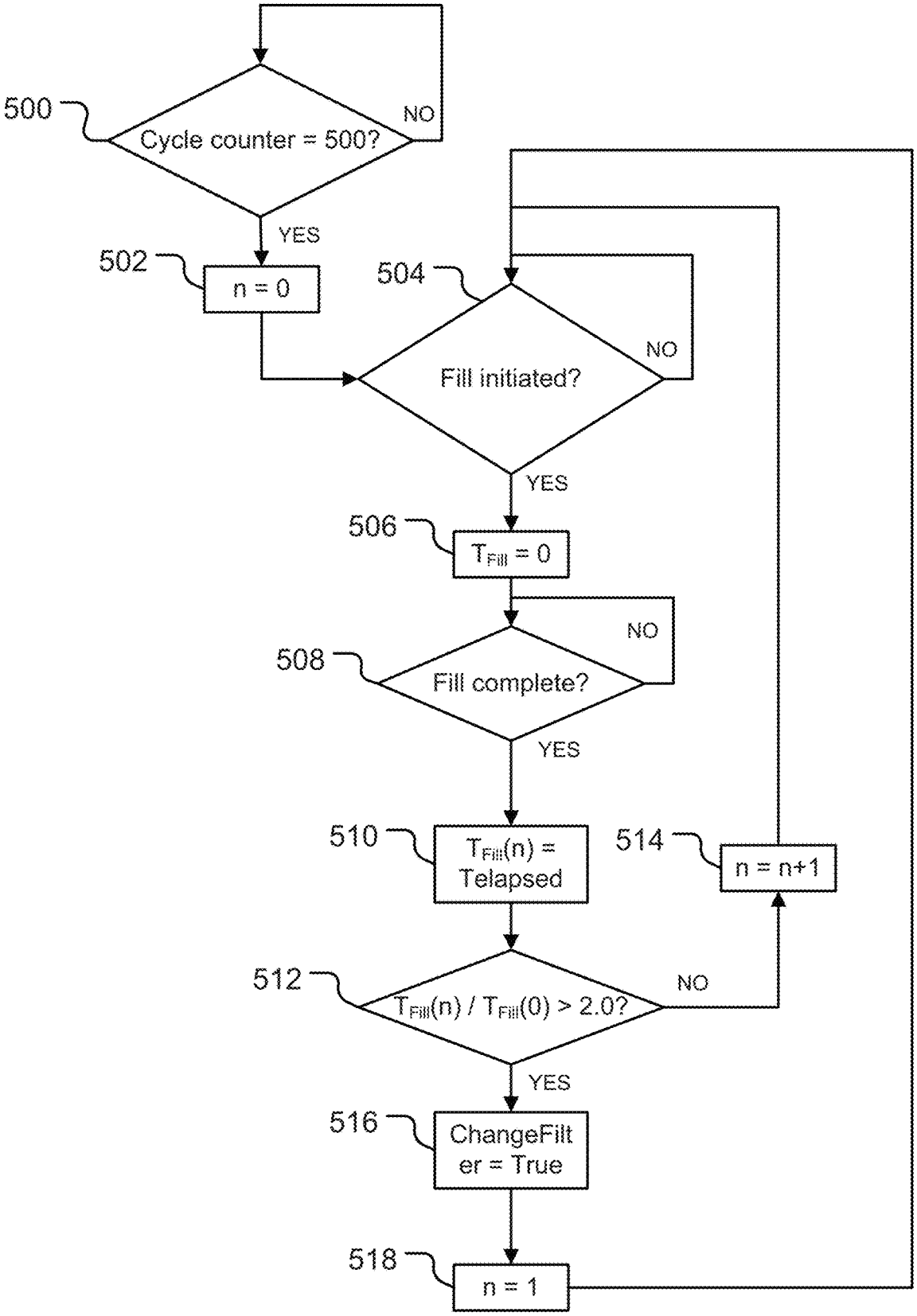
FIG. 5 is flow chart describing a method of determining whether the water filter of the ice maker needs to be cleaned or replaced according to an embodiment of the invention.

Yet another similar process is shown in FIG. 5 wherein the time it takes for sump 70 of ice maker 10 to fill with water is monitored. This fill time will increase over time as water filter 58 (if one is used) begins to clog. The flowchart in FIG. 5 illustrates how this fill time is monitored and tested by controller 80.

Figure 4:
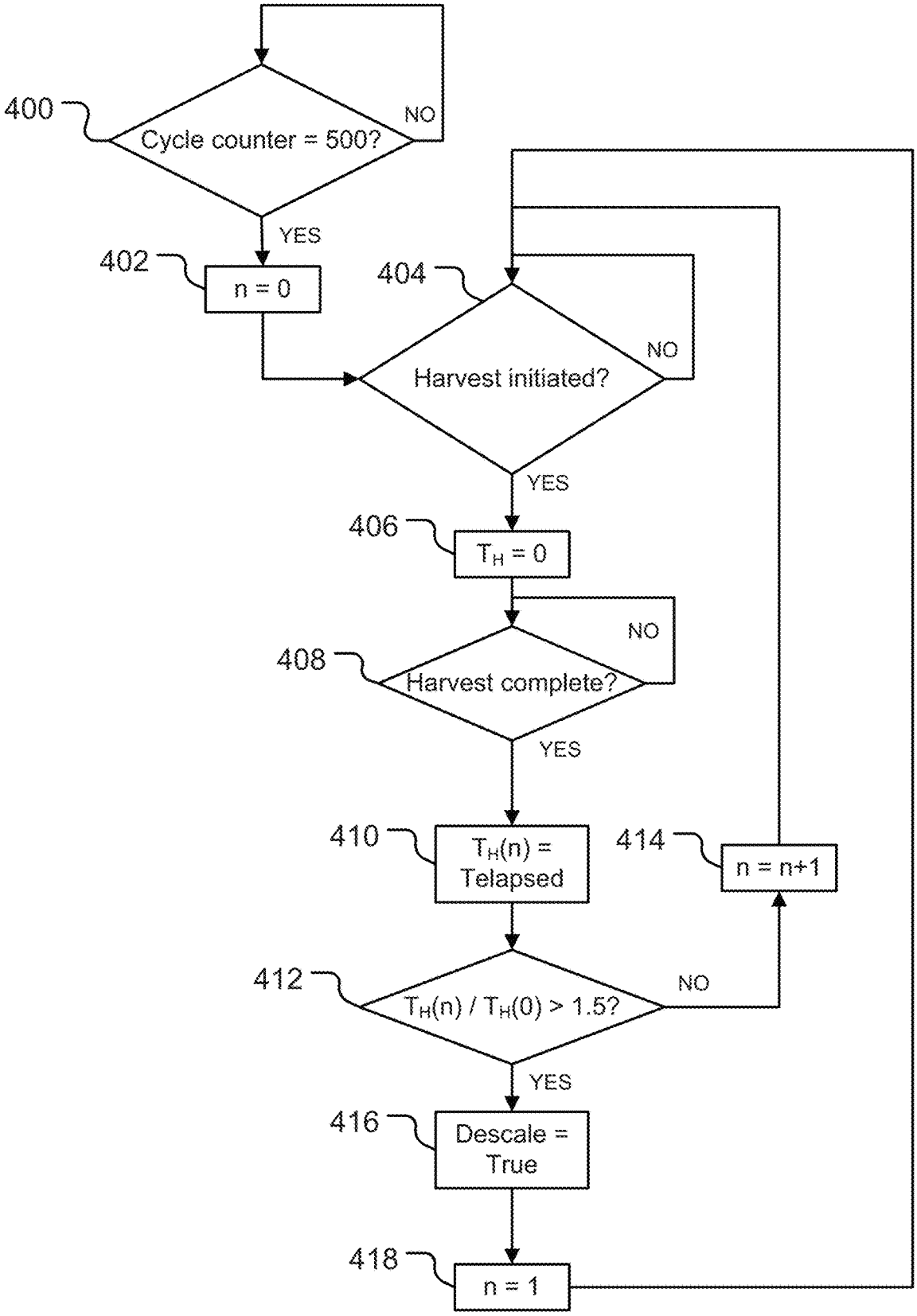
FIG. 4 is flow chart describing a method of determining whether the evaporator and water system of the ice maker needs to be descaled according to an embodiment of the invention.

As in FIGS. 3 and 4, in FIG. 5 ice maker 10 captures a baseline fill time when ice maker 10 reaches 500 cycles. This is done so that the baseline fill time is occurring after ice maker 10 has run for some length of time in its final location. In certain embodiments, the number of cycles may be less than about 500 (e.g., about 100, about 200, about 300, about 400). In yet other embodiments, the number of cycles may be more than about 500 (e.g., about 600, about 700, about 800, about 900, about 1000).

Thus at step 500, controller 80 checks whether ice maker 10 has reached 500 ice making cycles. If 500 cycles have been reached, then at step 502, controller 80 sets cycle counter n to 0. At step 504, ice maker 10 checks whether ice maker has initiated the fill process (i.e., filling sump 70 with water). Filling of water may be indicated by a rising water level in sump 70 as measured by a water level sensor. An exemplary water level sensor and system for measuring the water level in sump 70 is described in U.S. Ser. No. 14/162,365 entitled "Apparatus and Method for Sensing Ice Thickness and Detecting Failure Modes of an Ice Maker" filed on Jan. 23, 2014 by Broadbent and published as US. Pub. No. 2014/0208781, which is incorporated herein by reference in its entirety. If the fill of sump 70 is initiated, controller 80 proceeds to step 506, otherwise controller 80 will continue to wait until the fill is initiated. At step 506, a timer, preferably implemented in controller 80, for timing the length of time it takes to for sump 70 to fill with water to an ice making level is reset to zero ($T_{Fill}$=0). At step 508, controller 80 waits until the fill of sump 70 has completed. When the filling of sump 70 is completed at step 508, controller 80 records the elapsed time "$T_{elapsed}$" as variable $T_{Fill}(0)$ at step 510. This $T_{Fill}(0)$ is the baseline length of time that it takes to fill sump 70 to an ice making level when water filter 58 of ice maker 10 is new and clean.

At step 512, controller 80 checks to determine whether the fill time of the current cycle $T_{Fill}(n)$ has exceeded fill time of the first recorded cycle $T_{Fill}(0)$ (the baseline fill time) by about 100%. During the initial baseline run when n=0, $T_{Fill}(n)$ is equal to $T_{Fill}(0)$ and therefore controller 80 will proceed to step 514. At step 514, cycle counter n is incremented by 1. Ice maker 10 will then continue to make ice and controller 80 will repeat steps 504 through 512. Over time, as ice maker 10 continues to make ice, water filter 58 of ice maker 10 will being to clog and the time it takes to fill sump 70 will increase. Thus if at step 512, controller 80 determines that the current fill time $T_{Fill}(n)$ has exceeded the baseline fill time ($T_{Fill}(0)$) by about 100%, then at step 516 controller 80 sets a flag labeled "ChangeFilter" to "TRUE". This indicates that controller 80 has determined that water filter 58 needs to be cleaned or replaced. In various embodiments, the "ChangeFilter" flag may be set to "TRUE" if controller 80 determines that current fill time $T_{Fill}(n)$ is from about 1.50 to about 3.0 times the baseline fill time $T_{Fill}(0)$) (e.g., about 1.5 times, about 1.75 times, about 2.0 times, about 2.25 times, about 2.5 times, about 2.75 times, about 3.0 times). At step 518, the cycle counter n is then set to 1. Controller 80 then goes back to step 504 to begin monitoring fill times again.

Because the cycle counter n is set to 1 in step 518, the baseline fill time ($T_{Fill}(0)$) remains unchanged. This is important because the baseline fill time should be when water filter 58 of ice maker 10 is brand new and clean, not clogged as it would be when the ChangeFilter flag is set to TRUE.

Thus FIGS. 3, 4 and 5 show how controller 80 of ice maker 10 tracks freeze time, harvest time and fill time in order to recommend that ice maker 10 may need to have condenser 16 and/or condenser filter cleaned, ice maker 10 descaled, and/or the water filter 58 replaced. FIG. 6 illustrates an embodiment of how controller 80 may communicate this information to an end user.

In steps 600 and 602, controller 80 of ice maker 10 determines if it is connected, in this case either to the internet or to a portable electronic device 100 (e.g., a smart phone). If controller 80 is connected, controller 80 moves on to step 604 and checks if flag CleanCond is TRUE. If it is, then at step 606, controller 80 pushes the message "Condenser Filter Cleaning Recommended" (or a similar message) to the connected display of portable electronic device 100 and/or remote computer. Likewise, if at step 608 controller 80 determines that flag Descale is TRUE, at step 610, controller 80 pushes the message "Ice Machine Descaling Recommended" (or a similar message) to the connected display of portable electronic device 100 and/or remote computer. Likewise, if at step 612 controller 80 determines that flag ChangeFilter is TRUE, at step 614, controller 80 pushes the message "Water Filter Change Recommended" (or a similar message) to the connected display of portable electronic device 100 and/or remote computer. The subroutine ends at step 616. Accordingly, when a user is in close proximity to ice maker 10, controller 80 may push the aforementioned messages or notifications to portable electronic device 100 held or carried by a user when ice maker 10 turns on or is on.

Controller 80 may be directly or indirectly connected to portable electronic device 100 when portable electronic device 100 is in proximity to ice maker 10 in a variety of ways including, but not limited to, Bluetooth®, near field communications (NFC), Wi-Fi, via the cloud, or other wireless communication protocols.

In alternative embodiments, the notifications or messages pushed to portable electronic device 100 and/or remote computer may be additionally or alternatively displayed on a display on or in ice maker 10.

While various steps of several methods are described herein in one order, it will be understood that other embodiments of the methods can be carried out in any order and/or without all of the described steps without departing from the scope of the invention. Additionally, while the methods and apparatuses described herein are with respect to grid or cube-type ice makers, it will be understood that such methods and apparatuses can be utilized or applied to flake or nugget-type, and or to any other type of ice maker known in the art without departing from the scope of the invention.

Thus, there has been shown and described novel methods and apparatuses of an ice maker having reversing condenser fan motor for maintaining the condenser in a clean condition. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

What is claimed:

1. An ice maker for forming ice, the ice maker comprising:

a refrigeration system comprising a compressor, a condenser, and an evaporator, wherein the compressor, condenser and evaporator are in fluid communication by one or more refrigerant lines;

a water system comprising a water filter and a sump to hold water to be made into ice; and a control system comprising a controller configured to:

direct the ice maker to conduct an initial set of ice making cycles, wherein the ice maker makes one batch of ice during each ice making cycle, the initial set of ice making cycles comprising a plurality of consecutively conducted ice making cycles and the initial set of ice making cycles comprising the first ice making cycles conducted by the ice maker; and set at least one alarm parameter at a point in time after the initial set of ice making cycles is complete based on conditions at the point in time after the initial set of ice making cycles is complete;

wherein the controller sets the alarm parameter by setting at least one of a baseline freeze time, a baseline harvest time, and a baseline fill time;

wherein the controller is further configured to direct the ice maker to conduct a plurality of subsequent ice making cycles after setting the alarm parameter;

wherein the controller is configured to compare at least one of a measured harvest time, a measured freeze time, and a measured fill time of each of the plurality of subsequent ice making cycles to said at least one of the baseline freeze time, the baseline harvest time, and the baseline fill time;

wherein the controller is configured to push a notification to a portable electronic device after determining said at least one of the measured harvest time, the measured freeze time, and the measured fill time of one of the plurality of subsequent ice making cycles is excessive based on said comparison to said at least one of the baseline freeze time, the baseline harvest time, and the baseline fill time.

2. A method of determining if maintenance of an ice maker is required, the method comprising:

conducting an initial set of ice making cycles using the ice maker, wherein the ice maker makes one batch of ice during each ice making cycle, the initial set of ice making cycles comprising a plurality of consecutively conducted ice making cycles and the initial set of ice making cycles comprising the first ice making cycles conducted by the ice maker, wherein the ice maker comprises:

a refrigeration system comprising a compressor, a condenser, and an evaporator, wherein the compressor, condenser and evaporator are in fluid communication by one or more refrigerant lines;

a water system comprising a water filter and a sump to hold water to be made into ice; and a control system comprising a controller and an appliance transceiver; and at point in time after the initial set of ice making cycles is complete, setting at least one alarm parameter based on conditions at the point in time after the initial set of ice making cycles is complete;

directing the ice maker via the controller to conduct a plurality of subsequent ice making cycles after setting the alarm parameter;

comparing subsequent performance of the ice maker during the subsequent ice making cycles to the at least one alarm parameter; and pushing a notification to a portable electronic device after determining the subsequent performance of the ice maker exceeds the alarm parameter, wherein the control system is configured to communicate with the portable electronic device indirectly via a cloud network, wherein the appliance transceiver connects the controller to the cloud network, and wherein the portable electronic device comprises a device transceiver connecting the portable electronic device to the cloud network;

wherein said setting the at least one alarm parameter comprises setting at least one of a baseline freeze time, a baseline harvest time, and a baseline fill time;

wherein the method further comprises comparing at least one of a measured harvest time, a measured freeze time, and a measured fill time of each of the plurality of subsequent ice making cycles to said at least one of the baseline freeze time, the baseline harvest time, and the baseline fill time; and wherein said pushing the notification to the portable electronic device occurs after determining at least one of the measured harvest time, the measured freeze time, and the measured fill time of any of the plurality of subsequent ice making cycles is excessive based on said comparison to said at least one of the baseline freeze time, the baseline harvest time, and the baseline fill time.

3. The method as set forth in claim 2, wherein said setting the at least one alarm parameter comprises setting at least three alarm parameters at the point in time after the initial set of ice making cycles is complete.

4. The method as set forth in claim 2, further comprising receiving a control input to the controller at said point in time after the initial set of ice making cycles is complete and wherein said setting the at least one alarm parameter is responsive to said receiving the control input.

5. The method as set forth in claim 4, wherein the ice maker comprises at least one of a harvest sensor, a water level sensor, and a temperature sensor configured to provide the control input.

6. The method as set forth in claim 2, further comprising receiving a signal from the cloud network.

7. The method of claim 2, wherein the cloud network includes a computer resource of one or more of (i) an owner of the ice maker, (ii) a manufacturer of the ice maker, (iii) a servicer of the ice maker, and (iv) a dealer of the ice maker.

8. The method of claim 2, wherein the appliance transceiver communicates to the cloud network using one of GSM, CDMA, and UMTS.

9. The ice maker of claim 1, wherein the controller sets the alarm parameter by setting a baseline harvest time.

10. The ice maker of claim 9, wherein the controller is configured to compare a measured harvest time of each of the plurality of subsequent ice making cycles to the baseline harvest time.

11. The ice maker of claim 10, wherein the control system comprises a transceiver and the controller is configured to use the transceiver to push a notification to the portable electronic device via a cloud network after determining the measured harvest time is excessive based on said comparison of the measured harvest time with the baseline harvest time.

12. The ice maker of claim 1, wherein the control system comprises a transceiver and the controller is configured to use the transceiver to push a notification to the portable electronic device via a cloud network, the notification including an indication that the water filter should be replaced.

13. The ice maker of claim 1, wherein the controller sets the alarm parameter by setting a baseline fill time.

14. The ice maker of claim 13, wherein the controller is configured to compare a measured fill time of each of the plurality of subsequent ice making cycles to the baseline fill time.

15. The ice maker of claim 14, wherein the control system comprises a transceiver and the controller is configured to use the transceiver to push a notification to the portable electronic device via a cloud network after determining the measured fill time is excessive based on said comparison of the measured fill time with the baseline fill time.

16. The ice maker of claim 1, wherein the control system comprises a transceiver configured to indirectly connect the controller to the portable electronic device using a cellular communication protocol and via a cloud network.

* * * * *